US007428933B2

(12) United States Patent
Miller et al.

(10) Patent No.: US 7,428,933 B2
(45) Date of Patent: Sep. 30, 2008

(54) LATCHABLE HANGER ASSEMBLY AND METHOD FOR LINER DRILLING AND COMPLETION

(75) Inventors: Troy A. Miller, Bellville, TX (US); George Givens, Spring, TX (US); Morten Myhre, Tananger (NO)

(73) Assignee: Baker Hughes Incorporated, Houston, TX (US)

( * ) Notice: Subject to any disclaimer, the term of this patent is extended or adjusted under 35 U.S.C. 154(b) by 113 days.

(21) Appl. No.: 11/489,039

(22) Filed: Jul. 19, 2006

(65) Prior Publication Data

US 2007/0107911 A1 May 17, 2007

Related U.S. Application Data

(60) Provisional application No. 60/700,555, filed on Jul. 19, 2005.

(51) Int. Cl.
*E21B 23/00* (2006.01)
*E21B 23/01* (2006.01)

(52) U.S. Cl. ..... 166/382; 166/208; 166/242.9; 166/380; 175/22

(58) Field of Classification Search ..... 166/380, 166/242.9, 290, 382, 208; 175/22, 23, 171, 175/230
See application file for complete search history.

(56) References Cited

U.S. PATENT DOCUMENTS 3,077,227 A * 2/1963 Haeber ..... 166/352
3,223,159 A * 12/1965 Brown ..... 166/290
3,732,143 A * 5/1973 Joosse ..... 175/6
4,580,631 A 4/1986 Baugh ..... 166/208
4,898,243 A * 2/1990 Lindsey et al. ..... 166/290
4,942,924 A * 7/1990 Duncan ..... 166/290
5,497,840 A 3/1996 Hudson ..... 175/72
5,613,567 A 3/1997 Hudson ..... 175/72
5,794,694 A * 8/1998 Smith, Jr. ..... 166/212
5,823,254 A 10/1998 Dobson et al. ..... 166/51
5,829,525 A 11/1998 Dobson et al. ..... 166/278
5,871,050 A 2/1999 Dobson et al. ..... 166/278
6,009,943 A * 1/2000 Yokley et al. ..... 166/125
6,196,336 B1 * 3/2001 Fincher et al. ..... 175/101
6,223,823 B1 * 5/2001 Head ..... 166/290
6,854,533 B2 * 2/2005 Galloway et al. ..... 175/22
6,880,636 B2 * 4/2005 Rogers et al. ..... 166/290
7,004,264 B2 * 2/2006 Simpson et al. ..... 175/57
7,172,025 B2 * 2/2007 Eckerlin ..... 166/380
7,320,371 B2 * 1/2008 Mocivnik et al. ..... 175/57
2002/0185281 A1 * 12/2002 Buzinsky et al. ..... 166/380
2003/0132032 A1 * 7/2003 Metcalfe et al. ..... 175/57

(Continued)

FOREIGN PATENT DOCUMENTS

EP 1006260 A2 * 6/1999

(Continued)

*Primary Examiner*—David J. Bagnell
*Assistant Examiner*—Cathleen R Hutchins
(74) *Attorney, Agent, or Firm*—Shawn Hunter

(57) ABSTRACT

Methods and systems for conducting liner drilling and subsequent completion of the drilled section by cementing and anchoring the liner into place. The methods and systems prevent the liner from being cemented in in a bent or corkscrewed configuration. Additionally, there are no exterior components associated with the liner during drilling so as to allow relatively unrestricted return of drilling mud and cuttings.

17 Claims, 4 Drawing Sheets

U.S. PATENT DOCUMENTS

| | | | | |
|---|---|---|---|---|
| 2004/0003944 | A1* | 1/2004 | Vincent et al. | 175/57 |
| 2004/0026126 | A1* | 2/2004 | Angman | 175/57 |
| 2004/0112639 | A1* | 6/2004 | Chen et al. | 175/22 |
| 2004/0124015 | A1* | 7/2004 | Vail et al. | 175/171 |
| 2004/0168799 | A1* | 9/2004 | Simonds et al. | 166/278 |
| 2004/0221997 | A1* | 11/2004 | Giroux et al. | 166/380 |
| 2005/0006106 | A1 | 1/2005 | Hirth et al. | 166/382 |
| 2005/0023001 | A1* | 2/2005 | Hillis | 166/380 |
| 2005/0051342 | A1 | 3/2005 | Campbell et al. | 166/380 |
| 2005/0150690 | A1* | 7/2005 | Moriarty | 175/57 |
| 2006/0196695 | A1* | 9/2006 | Giroux et al. | 175/57 |
| 2007/0034408 | A1* | 2/2007 | Benzie et al. | 175/57 |

FOREIGN PATENT DOCUMENTS

| | | | |
|---|---|---|---|
| EP | 1006260 | A2 | 7/2000 |

* cited by examiner

LATCHABLE HANGER ASSEMBLY AND METHOD FOR LINER DRILLING AND COMPLETION

This application claims the priority of U.S. Provisional Patent Application Ser. No. 60/700,555 filed Jul. 19, 2005.

BACKGROUND OF THE INVENTION

1. Field of the Invention

The invention relates generally to devices and methods for conducting liner drilling and subsequent completion of the drilled section by securing the liner into place by anchoring and cementing.

2. Description of the Related Art

In its basic form, a wellbore is drilled using a drill bit that is attached to a drill string fashioned of drill pipe. When the wellbore is drilled to an original desired depth, the drill string and bit are removed from the hole. Then steel casing is inserted into the borehole and cemented in place as a protective tubular sheath to prevent collapse of the borehole wall. The term "casing," as used herein will refer to those protective sheaths that extend along a portion of the wellbore all the way to the surface. The well can then be drilled to deeper depths in successively smaller diameter intervals below the original depth. These lower intervals are then lined with wellbore liners. As used herein, the term "liner" will refer to those protective sheaths that extend along a portion of the wellbore, but do not extend all the way to the surface.

In addition to traditional drilling using drill strings made up of drill pipe, techniques have been developed recently for casing drilling and liner drilling. In casing drilling, the bottom hole assembly containing the drill bit is threaded to a section of casing and, after drilling, the casing is hung at the top of the wellbore. Liner drilling is a similar concept. In liner drilling, the liner to be cemented in serves as a part of the drilling string while traditional drill pipe usually forms the upper part of the drill string. The bit can be attached to the liner and the liner then rotated within the borehole. Alternatively, a mud motor is attached to liner and the mud motor is used to turn the bit while the liner remains stationary. When liner drilling is completed, the drill pipe portion of the drill string is detached from the liner and withdrawn from the wellbore. The liner portion of the drilling string remains in the borehole, set on the bottom of the hole and is later cemented into place. The bit and mud motor are also left in the hole.

A significant problem with this conventional liner drilling process is that the liner can deform by bending or corkscrewing under its own weight when set down on bottom. This is especially true of very long liners. If the liner is cemented in this condition, it will be permanently deformed and perhaps be unusable for passing large diameter tools through. For this reason, a number of "one-trip" liner drilling arrangements have been developed that incorporate liner hangers into the drilling string on the upper end of the liner so that the liner can be anchored to the pre-existing casing after cementing. An example of a "one-trip" liner drilling system is described in U.S. Pat. No. 5,497,840, issued to Hudson.

A major problem with "one trip" liner drilling systems is their ability to return drill cuttings to the surface of the wellbore. The liner portion of the drill string has a much greater diameter than traditional drill pipe. As a result, the annulus surrounding the liner portion is quite small, leaving little room for pumped down drilling mud and generated cuttings to return to the surface of the well. While this problem is inherent to the process of liner drilling, it is made substantially worse by the presence of any exterior components that extend outwardly into the annulus beyond the diameter of the liner. Thus, externally mounted hangers or packers, that might be used to hang the liner in tension from the casing or liner above could not be run in with the liner during the drilling operation without destroying the ability to drill and remove cuttings effectively during drilling. Thus, there is a need to be able to conduct liner drilling with minimal exterior components to allow annular bypass of returning drilling mud and cuttings.

The present invention addresses the problems of the prior art.

SUMMARY OF THE INVENTION

The invention provides improved methods and systems for conducting liner drilling and subsequent completion of the drilled section by cementing and anchoring the liner into place. The methods and systems of the present invention prevent the liner from being cemented in in a bent or corkscrewed configuration. Additionally, the systems and methods of the present invention minimize the number of exterior components associated with the liner during drilling so as to allow relatively unrestricted return of drilling mud and cuttings.

In accordance with preferred embodiments of the invention, a liner is drilled into a wellbore below original depth using a running tool. A liner setting sleeve having a substantially smooth exterior is affixed to the top of the liner, thereby permitting substantially unrestricted annular bypass and minimal exterior mechanical complexity during drilling. Once the target depth has been reached, the liner is set on the bottom of the hole and the liner setting tool is released from the liner. The running string is then withdrawn from the hole. Next, a liner hanger/packer assembly is run into the hole. The liner hanger/packer assembly has a latch-in seal assembly to latch into the liner setting sleeve. Once, latched, the liner is lifted off the bottom of the hole. A liner packer is then set to hang the liner in tension. Thereafter, the liner may be anchored to the casing above and cemented into place within the wellbore in a substantially straight and true condition.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
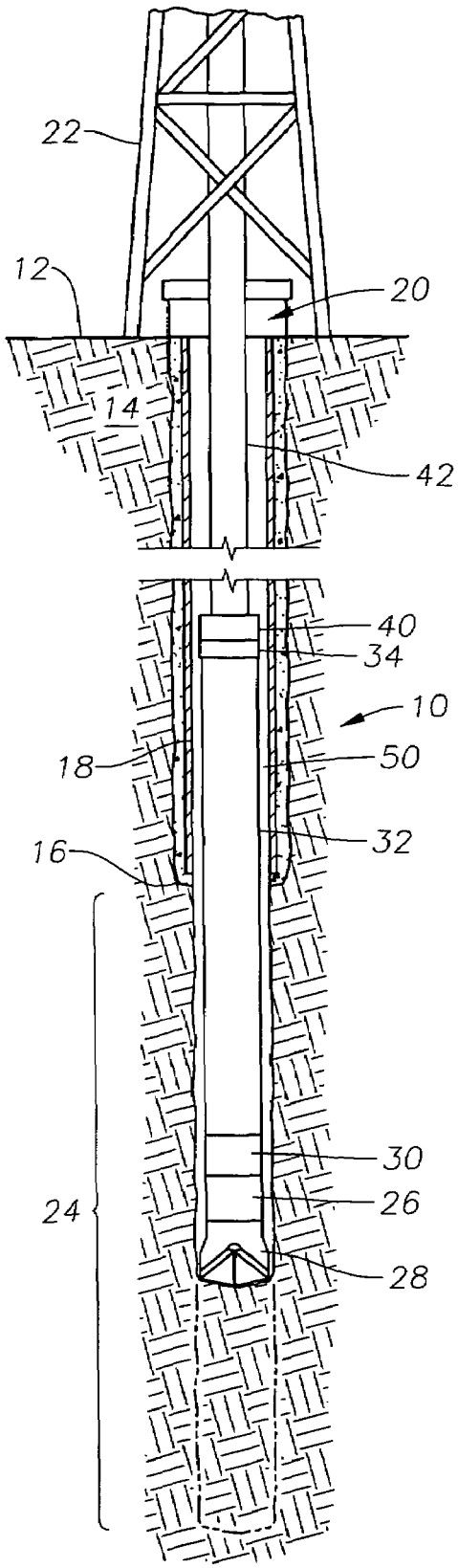
FIG. 1 is a schematic side, cross-sectional view of an exemplary borehole being drilled from the original depth to a lower interval using liner drilling.
Figure 7:
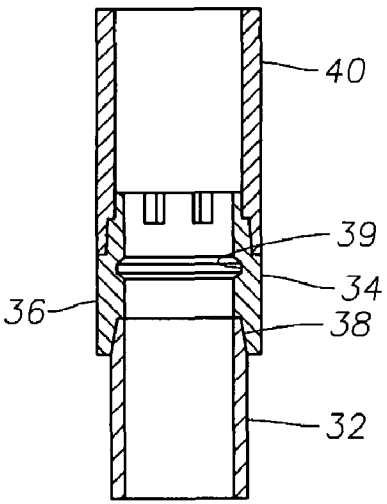
FIG. 7 is an enlarged, cross-sectional side view of the liner setting sleeve.

FIG. 1 depicts an exemplary wellbore 10 that has been drilled from the surface 12 through the earth 14 to an original depth 16. Metallic casing 18 has been cemented in the wellbore 10 from the surface 12 down near the original depth 16. A liner drilling system 20 has been inserted into the wellbore 10 from a drilling rig 22 at the surface 12. In FIG. 1, the liner drilling system 20 is drilling a deeper interval portion 24 of the wellbore 10. The liner drilling system 20 includes a bottom hole assembly 26 with a drill bit 28 thereupon. The bottom hole assembly 26 is attached by a landing collar 30 to a section of liner 32. The liner section 32 is of a length that approximates the length of the deeper interval portion 24 to be drilled. Secured to the upper end of the liner section 32 is a liner setting sleeve 34. The liner setting sleeve 34 is shown in greater detail in FIG. 7. It is noted that the liner setting sleeve 34 has a smooth external radial surface 36 and is affixed by a threaded connection 38 to the upper end of the liner section 32. It is noted that, although the liner setting sleeve 34 is depicted as having a greater outer diameter than the liner 32, the diametrical increase is, in actuality, very small, and presents no obstacle to the passage of drilling mud and cuttings. The liner setting sleeve 34 defines a latching groove 39 within. A suitable liner setting sleeve is the HRD™ Liner Setting Sleeve, which is available commercially from Baker Oil Tools of Houston, Tex. A short PBR (polished bore receptacle) 40 is secured to the upper end of the liner setting sleeve 34.

Figure 8:
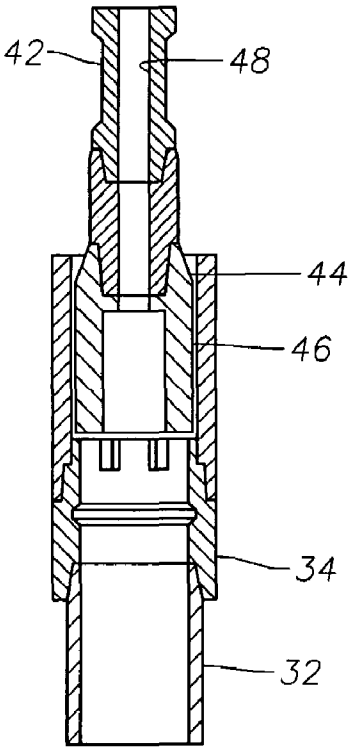
FIG. 8 is an enlarged, cross-sectional side view depicting the running tool attached to the liner setting sleeve.

The liner drilling system 20 also includes a length of running string formed of drill pipe 42 that extends downwardly from the drilling rig 22 and is secured to the liner setting sleeve 34 and PBR 40 at its lower end. FIG. 8 illustrates an exemplary releasable interconnection between the drill pipe running string 42 and the liner section 32. A packoff 44 is disposed within the PBR 40 to secure the two components together. A hydraulic releasing tool 46 is also disposed within the PBR 40 and setting sleeve 34. Suitable commercially available devices for use as the packoff 44, setting sleeve 34, and hydraulic releasing tool 46 are those within a standard HRD™ Hydraulic Release Setting Tool, which is available commercially from Baker Oil Tools of Houston, Tex. With further reference to FIG. 8, it is noted that the drill pipe running string 42 defines a central flowbore 48 for passage of drilling mud downwardly to the drill bit 28. During drilling, drilling mud is pumped downwardly through the central flowbore 48 and drilling mud and drill cuttings are circulated upwardly through the annulus 50 to the surface 12. Because there are no external packers or hangers on the drilling system 20, the cuttings and mud have a substantially unrestricted return path through the annulus 50.

Figure 2:
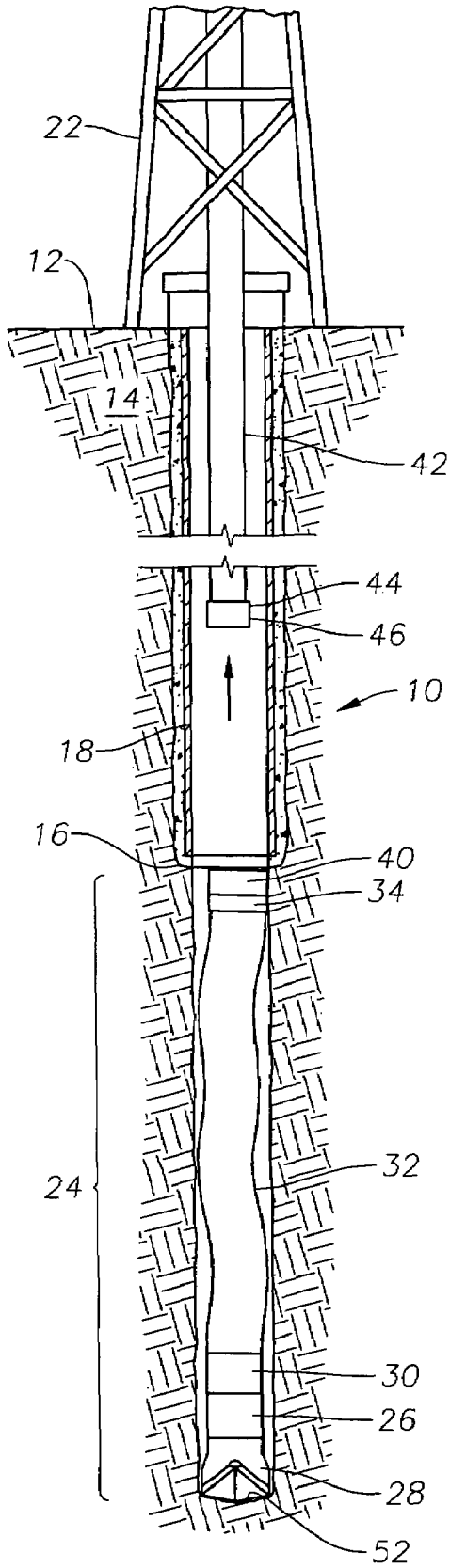
FIG. 2 is a schematic side, cross-sectional view of the borehole shown in FIG. 1 now with the running tool being removed.

FIG. 2 shows the wellbore 10 now drilled to the deeper interval portion 24. The drill pipe running string 42 has been released from the liner portion 32 by actuation of the hydraulic releasing tool 46 and is being removed from the wellbore 10. At this point, the liner portion 32, bottom hole assembly 26 and bit 28 are resting on the bottom 52 of the drilled deeper interval portion 24 of the wellbore 10. The liner portion 32 may become deformed in this condition by bending, buckling, or corkscrewing.

Figure 3:
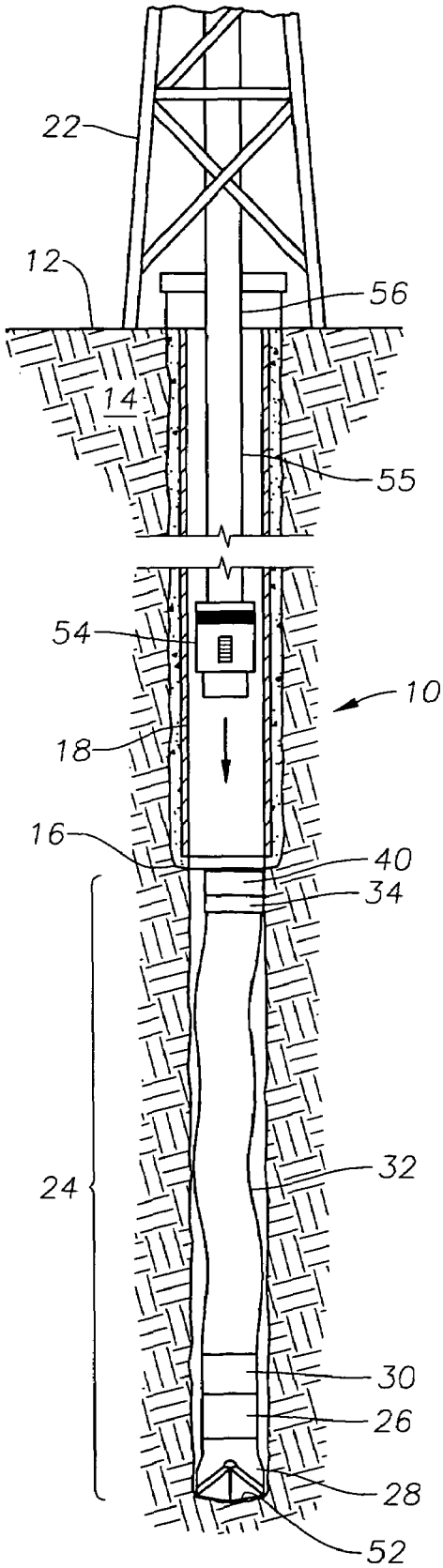
FIG. 3 is a schematic side, cross-sectional view of the borehole of FIGS. 1 and 2 now with a liner hanger/packer assembly being latched into the liner setting sleeve.
Figure 9:
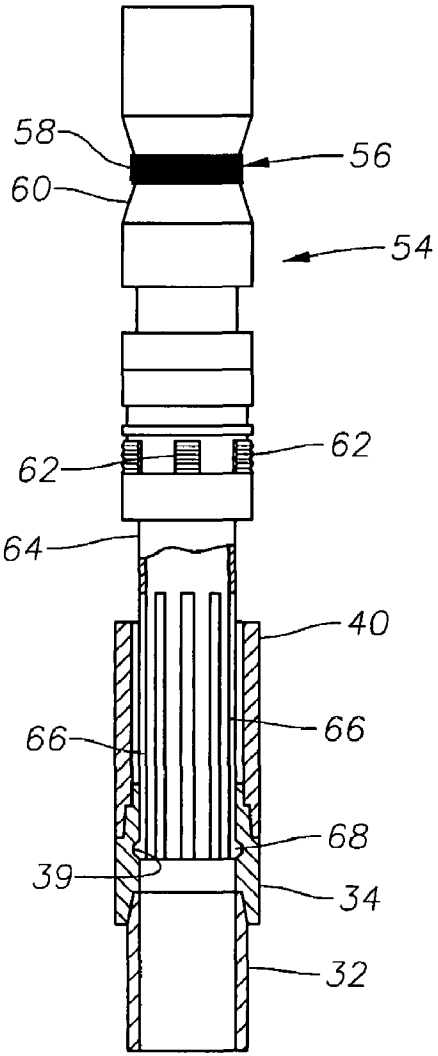
FIG. 9 is an enlarged, partial cross-sectional side view showing the liner hanger/packer latched into the liner setting sleeve.

FIG. 3 illustrates the next step in the liner drilling process wherein a latching liner hanger assembly 54 is run into the wellbore 10 on a drill pipe running string 55 to be secured to the upper end of the liner portion 32 by latching engagement. FIG. 9 illustrates the latching arrangement and the latching liner hanger assembly 54 in greater detail. The latching liner hanger assembly 54 includes a liner packer 56 having an elastomeric sealing element 58 that is set by axial movement upon ramped surface 60. The packer 56 is preferably actuated hydraulically, in a manner that is known in the art. The hanger assembly 54 also includes a set of anchoring slips 62 that are moveable radially outwardly to form a biting engagement with a surrounding tubular member. The slips 62, like the packer 56, are preferably hydraulically actuated. In addition, the hanger assembly 54 includes a latching sub 64 at its lower end. The latching sub 64 includes a set of collets 66 with radially outward projections 68 that are shaped and sized to reside within the groove 39 of the liner setting sleeve 34.

Figure 4:
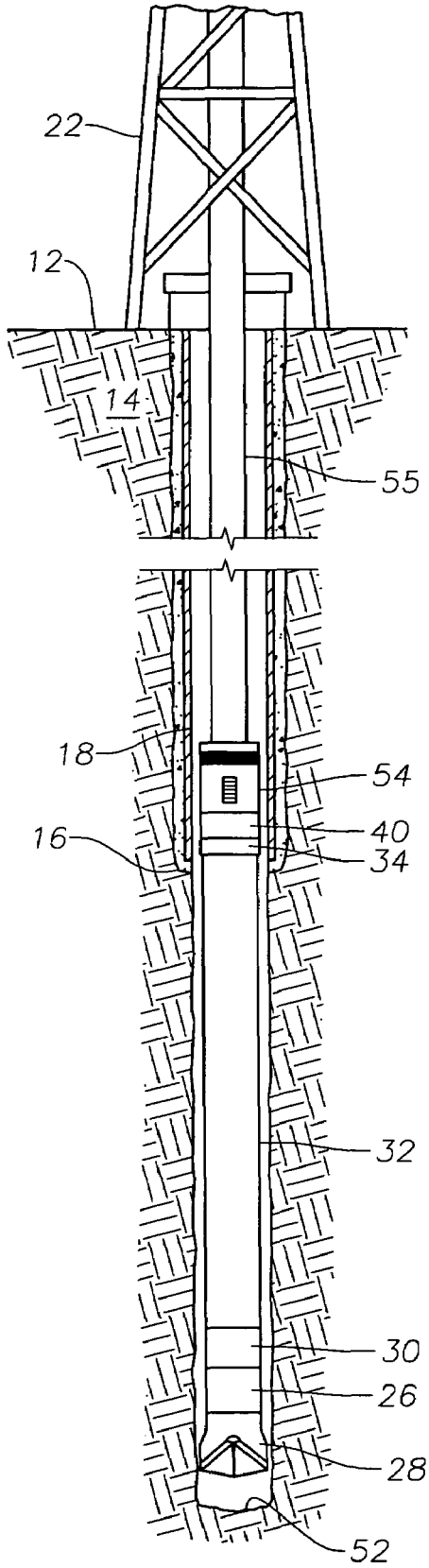
FIG. 4 is a schematic side, cross-sectional view of the borehole of FIGS. 1-3 now with the liner being picked up off the bottom of the borehole.
Figure 5:
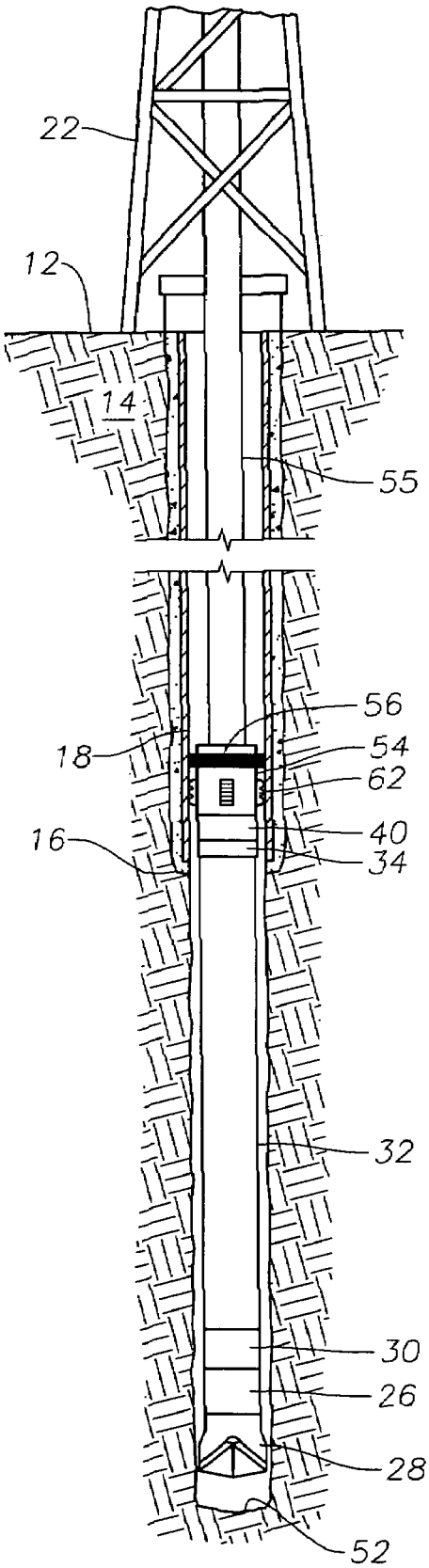
FIG. 5 depicts the setting of a liner packer to hang the liner in tension.

FIG. 4 shows the subsequent step of lifting the liner 32 off the bottom 52 so that the liner 32 is hanging in tension. Because the liner 32 is hanging in tension, the deformations from corkscrewing or bending are undone. At this point, the hanger assembly 54 is actuated to urge the slips 62 and sealing element 58 of the packer 56 radially outwardly and into engagement with the casing 18. This ties the liner 32 in with the casing 18 above. In FIG. 5, the liner packer 56 and slips 62 are now in the set position.

Figure 6:
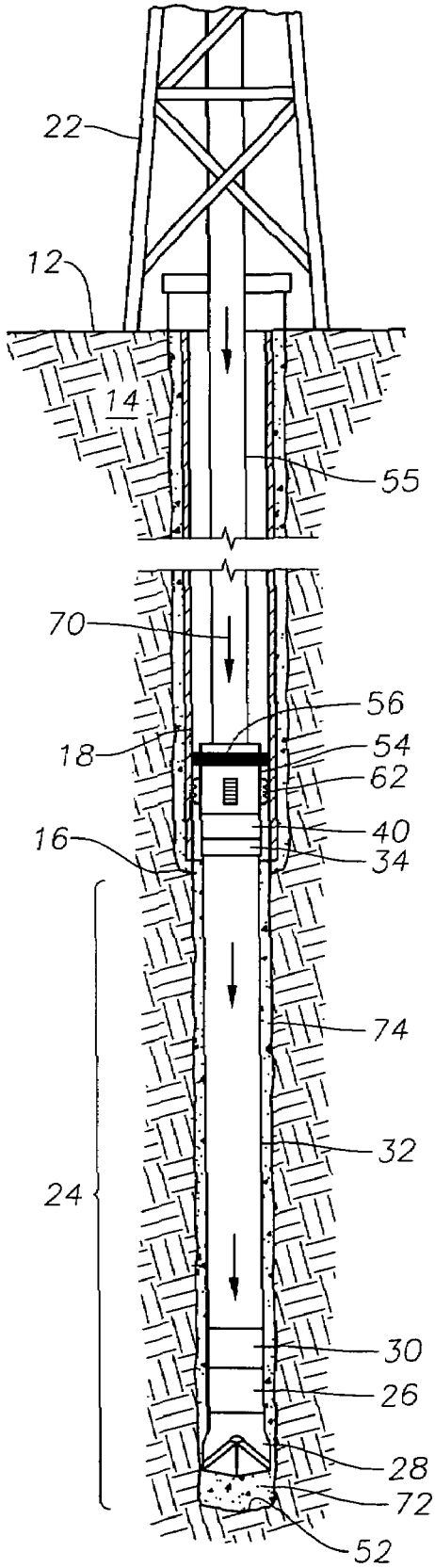
FIG. 6 depicts a cementing operation to secure the liner in place.

FIG. 6 illustrates the step of cementing in the liner 32. Conventional cementing techniques are used to circulate cement down through the flowbore of the drill pipe running tool 55, as depicted by arrows 70. The cement then passes through the liner 32 and the bit 28 to be deposited at the bottom 52 of the wellbore 10. From there, placed cement 72 will rise to fill in the annular space 74 between the liner 32 and the sidewalls of the extended length portion 24 of wellbore 10. The interior of the drill string running tool 55 and the liner 32 are then cleaned using wiper darts of a type known in the art. As the techniques of cementing in liners are well known to those of skill in the art, they will not be described in further detail herein.

After the completion of cementing, the drill string running tool 55 is then removed from the latching liner hanger assembly 54. This is usually accomplished by rotating the drill string running tool 55 to unthread the hanger assembly 54 and then withdrawing the running tool 55 from the wellbore 10.

Those of skill in the art will recognize that the methods and systems of the present invention provide a number of advantages over conventional liner drilling and placing systems. First, they help ensure that the liner 32 will not be deformed from compression bending or corkscrewing at the time that it is cemented in or anchored to the casing 18. As a result, there will be fewer subsequent problems with running large diameter tools through the liner 32 at a later point in development of the wellbore 10. Additionally, the liner drilling process is made more effective because there is a minimum complication of the annulus 50 during the drilling phase. There are no external packers or slips associated with the liner 32 during the drilling phase, and therefore, the cuttings and mud can more easily reach the surface 12.

Those of skill in the art will recognize that numerous modifications and changes may be made to the exemplary designs and embodiments described herein and that the invention is limited only by the claims that follow and any equivalents thereof.

What is claimed is:

1. A method of conducting liner drilling and completion within a wellbore previously drilled to an original depth, the method comprising the steps of:

assembling a liner drilling system having a running string portion, a liner, and a drill bit associated with a lower end of the liner portion;

liner drilling a deeper interval portion within the wellbore with the liner drilling system;

detaching the running string portion from the liner so that the liner rests within the deeper interval portion;

affixing a liner hanger device to an upper portion of the liner;

lifting the liner within the deeper interval portion to hang the liner in tension;

anchoring the liner to a section of casing above the liner.

2. The method of claim 1 further comprising the step of cementing the liner into the deeper interval portion.

3. The method of claim 1 wherein the liner drilling system further comprises a liner setting sleeve that defines an interior latching groove and wherein the step of detaching the running string portion from the liner further comprises releasing the running string portion from the setting sleeve.

4. The method of claim 3 wherein the step of affixing a liner hanger to an upper portion of the liner further comprises securing a latching portion of the liner hanger device into the latching groove of the liner setting sleeve.

5. The method of claim 1 wherein the step of lifting the liner further comprises securing a latching device to a member associated with the liner and lifting a running tool associated with the member upwardly.

6. The method of claim 1 wherein the step of anchoring the liner to a section of casing above the liner comprises setting a slip.

7. The method of claim 6 wherein the step of anchoring the liner to a section of casing further comprises setting a packer.

8. A method of conducting liner drilling and completion within a wellbore previously drilled to an original depth, the method comprising the steps of:

assembling a liner drilling system having a running string portion, a liner, a liner setting sleeve associated with a upper end of the liner, and a drill bit associated with a lower end of the liner portion;

liner drilling a deeper interval portion within the wellbore with the liner drilling system;

detaching the running string portion from the liner setting sleeve so that the liner rests within the deeper interval portion;

affixing a liner hanger device to the liner setting sleeve;

lifting the liner within the deeper interval portion to hang the liner in tension;

anchoring the liner to a section of casing above the liner.

9. The method of claim 8 wherein the step of affixing a liner hanger device to the liner setting sleeve further comprises latching the liner hanger device into the liner setting sleeve.

10. The method of claim 8 further comprising the step of cementing the liner into the deeper interval portion.

11. The method of claim 8 wherein the step of affixing a liner hanger device to the liner setting sleeve further comprises running a latching liner hanger into the wellbore on a running string and latching the latching liner hanger into the liner setting sleeve.

12. The method of claim 11 wherein the step of lifting the liner further comprises pulling upwardly on the running string.

13. The method of claim 8 wherein the step of detaching the running string portion from the liner setting sleeve further comprises actuating a hydraulic release tool.

14. A system for conducting liner drilling and completion in a wellbore previously drilled to an original depth, the system comprising:

a liner having upper and lower axial ends;

a liner setting sleeve affixed to the upper end of the liner;

a drill bit associated with the lower end of the liner;

a drill pipe running string that is secured to the liner for liner drilling and releasable from the liner after liner drilling;

a liner hanger that is securable with the liner setting sleeve, the liner hanger also having an anchoring member to secure the liner hanger to a casing above; and a running string releasably securable to the liner hanger for lifting the liner hanger and secured liner upwardly within the wellbore.

15. The system of claim 14 wherein the liner setting sleeve defines a latching groove for securing of the liner hanger.

16. The system of claim 14 wherein the anchoring member comprises a slip element.

17. The system of claim 16 wherein the liner hanger further comprises a packer device for forming a fluid seal with a surrounding tubular member.

* * * * *